US005092237A

United States Patent [19]

Beaufay et al.

[11] Patent Number: 5,092,237

[45] Date of Patent: Mar. 3, 1992

[54] SYSTEM USING AN ELECTROPYROTECHNIC DEVICE INTENDED TO TRIGGER THE OPERATION OF A GAS GENERATOR

[75] Inventors: Denis Beaufay, Orleans; Jean Boucard, Boulogne; Jean Holtz; André Winaver, both of Paris, all of France

[73] Assignee: Thomson-Brandt Armements, Boulogne Billancourt, France

[21] Appl. No.: 540,699

[22] Filed: Jun. 20, 1990

[30] Foreign Application Priority Data

Jun. 20, 1989 [FR] France ..... 89 08183

[51] Int. Cl.[5] ..... C06D 5/00

[52] U.S. Cl. ..... 102/531; 102/380; 102/489; 280/741; 422/166

[58] Field of Search ..... 102/202.5, 202.7, 380, 102/489, 530, 531; 280/741, 742; 422/165, 166

[56] References Cited

U.S. PATENT DOCUMENTS

| | | | |
|---|---|---|---|
| 2,703,960 | 3/1955 | Prentiss . | |
| 3,678,853 | 7/1972 | Kilmer . | |
| 3,945,322 | 3/1976 | Carlson et al. . | |
| 3,982,488 | 9/1976 | Rakawsky et al. | 102/380 |
| 4,602,565 | 7/1986 | MacDonald et al. . | |
| 4,944,225 | 7/1990 | Barker | 102/202.5 |

FOREIGN PATENT DOCUMENTS

| | | | |
|---|---|---|---|
| 0030498 | 6/1981 | European Pat. Off. . | |
| 0040011 | 11/1981 | European Pat. Off. . | |
| 1167120 | 4/1964 | Fed. Rep. of Germany . | |
| 1118847 | 12/1956 | France . | |
| 1194102 | 11/1959 | France | 102/380 |
| 1430432 | 1/1966 | France . | |
| 2132790 | 11/1972 | France . | |
| 2357861 | 2/1978 | France . | |
| 2591735 | 6/1987 | France | 102/530 |

*Primary Examiner*—Harold J. Tudor

*Attorney, Agent, or Firm*—Oblon, Spivak, McClelland, Maier & Neustadt

[57] ABSTRACT

An electropyrotechnic device for sequentially triggering the operation of a battery of gas generators. The ignition of double-base propellant blocks is obtained by the combination of EFI and an IFOC, arranged so that the airtight barrier between the cavity containing the donor secondary explosive and the downstream chamber containing the secondary receiving explosive is only one part of the closing element of the back end carrying the nozzles, integral with the ring. The control electronics of the EFI are contained inside a housing capping the back end of the powder generator with the entire system being closed by a cap.

8 Claims, 4 Drawing Sheets

SYSTEM USING AN ELECTROPYROTECHNIC DEVICE INTENDED TO TRIGGER THE OPERATION OF A GAS GENERATOR

BACKGROUND OF THE INVENTION

1. Field of the Invention

The invention relates to a system using an electropyrotechnic device intended to trigger sequentially the operation of a battery of gas generators.

2. Description of the Prior Art

An application of these systems is found, for example, in the area of the release of air-to-surface submissile rounds from a cargo aircraft calling for the use of gases formed by powder generators. Difficulties appear when the number of gas generators is increased, particularly with regard to reliability, because the precautions necessary to assure an acceptable rate of reliability then become very expensive in terms of cost and space.

These two requirements of increased reliability and decreased space requirement and weight serve as a basis for the optimized combination of the present invention.

SUMMARY OF THE INVENTION

Accordingly, one object of this invention is to provide a novel system using an electropyrotechnic device intended to trigger the operation of a powder generator placed inside a ring having a front end and a back end, the system has a downstream chamber containing a so-called IFOC (Inflammateur Fonctionant par Ondes De Choc, i.e., igniter operated by shock waves) secondary receiving explosive, which is able, by shock wave detonation, to cause flames which trigger the powder generator. The chamber is made in a first bore of a closing element of the back end of the ring which has a shape of a truncated cone with nozzles coming out in the side wall of the back end.

The system also includes an upstream cavity containing a donor secondary explosive and made in a second bore placed head-to-tail relative to the first bore and separated from the latter by an airtight barrier which consists of a zone of the closing element of the back end of the ring.

Also included is a so-called EFI projected-layer initiator positioned opposite the upstream cavity and producing, when it is initiated, a detonation in the upstream cavity. A housing caps the back end and has a bottom in the shape of a truncated cone which is complementary to the truncated cone of the back end of the ring.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
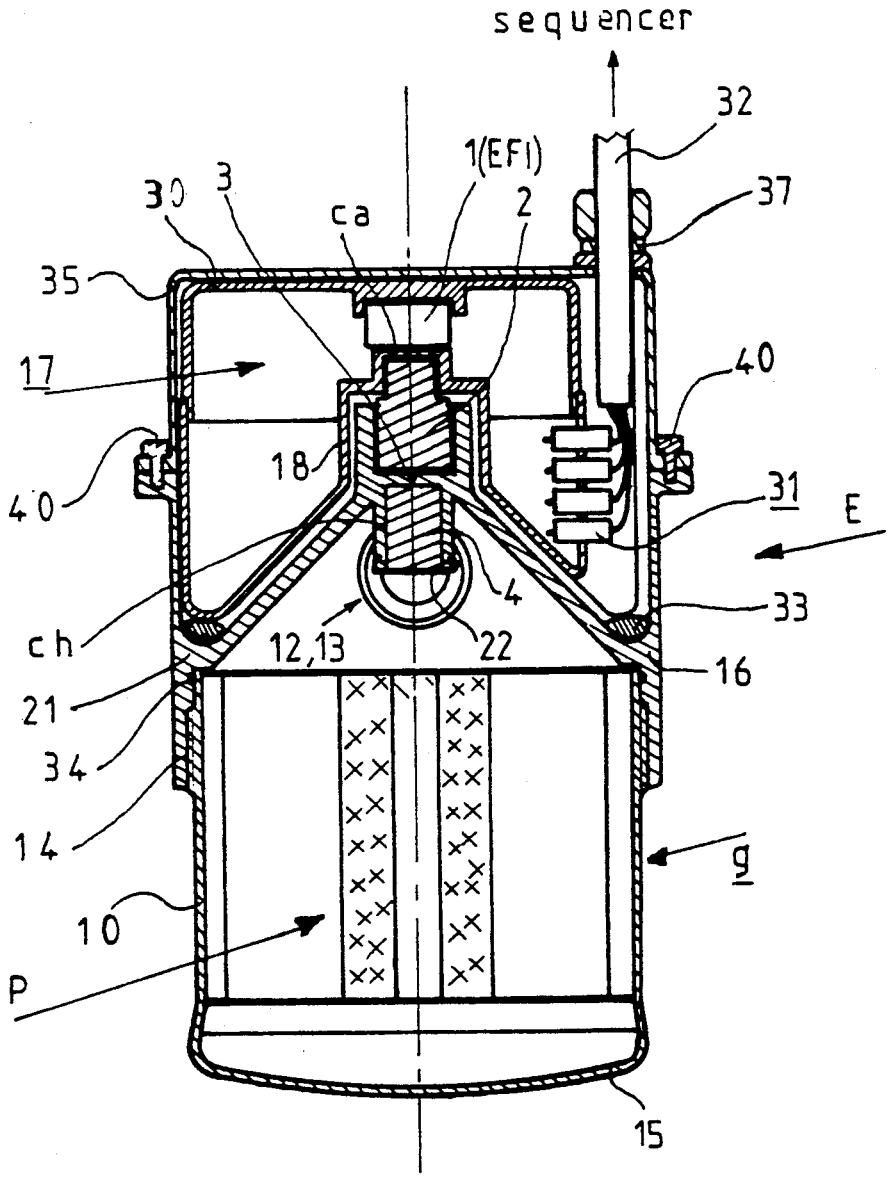
FIGS. 1 and 2 are sections along two orthogonal planes of a system according to the invention.
Figure 2:
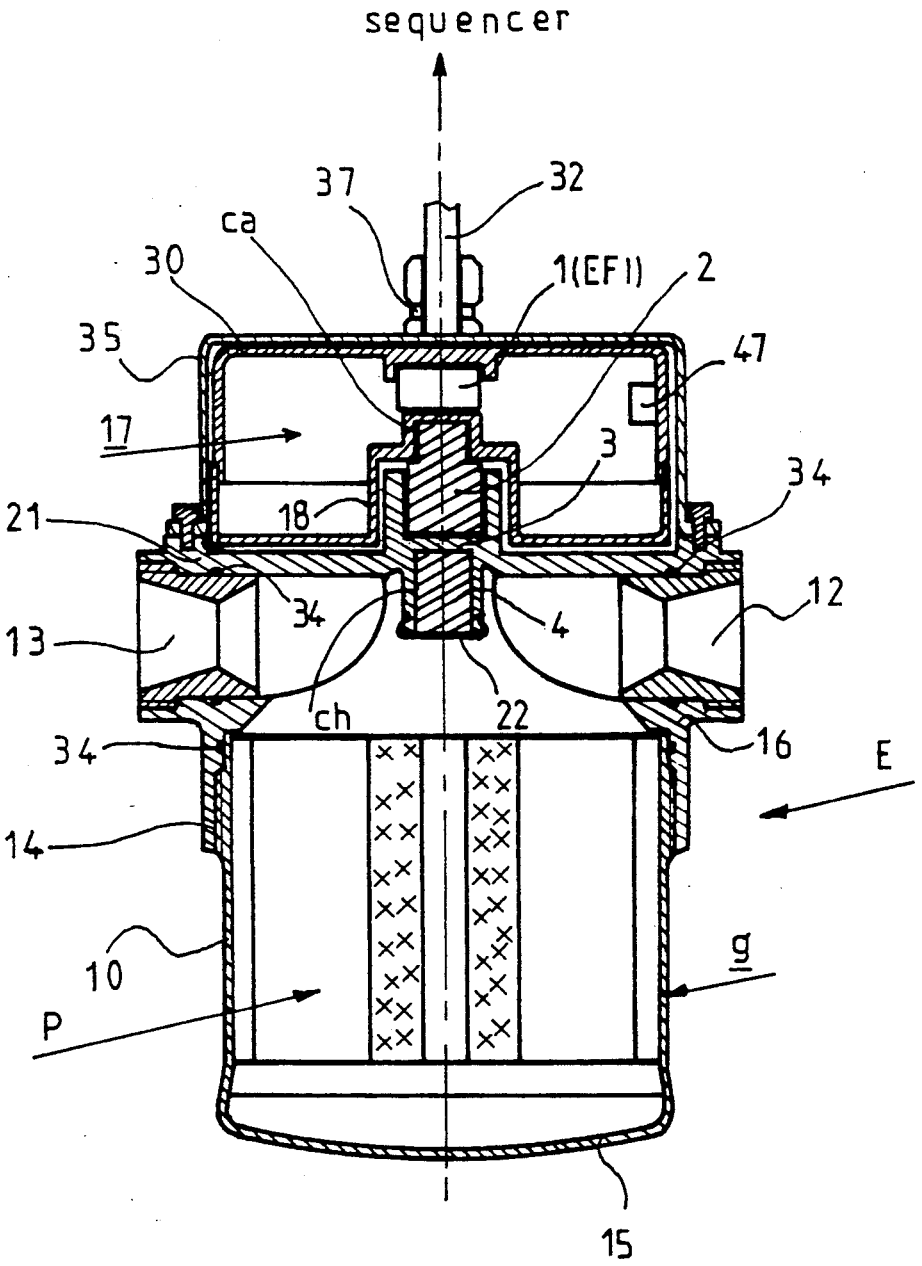

As FIGS. 1 and 2 show, an electropyrotechnic device (E) according to the invention essentially consists, for its ignition part, of a projected-layer initiator (1), more commonly known by the English terminology of "EFI" (Exploding Foil Initiator). The latter produces a detonation in an upstream cavity (Ca) which contains a donor secondary explosive (2). When the latter detonates, it produces a shock wave which is propagated through an airtight barrier (3) to a downstream chamber (Ch) containing a secondary receiving explosive (4) which is able, by detonation, to cause flames which, in turn, cause the combustion for the charging of powder (P) of gas generator (g). The igniter device of the gas generator thus is assured, according to the invention, by the combination of an EFI and an IFOC (igniter operating by shock wave).

Such a combination offers the advantage of avoiding the installation of safety means between the standard igniters and the pyrotechnic charges in the pyrotechnic chain, as is the case in the prior art. Further, the introduction of electric means inside gas generators is thus avoided.

Such an electropyrotechnic device (E) according to the invention is integrable at least partially in the very structure of gas generator (g) thus providing a compact and reliable finished product.

According to another characteristic of the invention, the system consists of such an igniter as described above which assures the correct start of the combustion of a charging of double-base propellant having a combustion profile and characteristics so that the pressure is maintained at an almost constant value during the entire period of the combustion. A closing pallet (22) is installed to close chamber (Ch) of the IFOC.

According to an embodiment illustrated by FIGS. 1 and 2, the charging of powder (P) is achieved inside a ring (10) whose front end (15) is hemispherical and whose back end (16), which carries nozzles (12, 13), is made integral with ring (10) by, for example, a thread (14). This back end (16) has the shape of a convergent truncated cone with nozzles (12) and (13) coming out of the side wall of this truncated cone. In the example described, there are two nozzles, diametrically opposite, but this number is not limiting.

Closing element (21) of back end (16) exhibits at the level of the vertex of the truncated cone two bores placed head-to-tail. One bore delimits the space of downstream chamber (Ch) containing secondary receiving explosive (4) and the other bore delimits the space of cavity (Ca) containing donor secondary explosive (2). A zone of closing element (21) constitutes an airtight barrier (3) of the IFOC. This barrier makes possible the propagation of the shock wave while exhibiting sufficient mechanical strength.

Back end (16) is capped with an airtight metallized plastic housing (17) whose bottom (18) also has the shape of a truncated cone, complementary to the convergent truncated cone defined above.

The two ends of these two truncated cones are fitted into one another, enclosing cavity (Ca) containing donor secondary explosive (2). Cover (30) of housing (17), which holds EFI (1) in position, is placed on the vertex of the truncated cone of housing (17). The latter contains the control electronics 47 which is supplied through its wall, via filters (31) and airtight passage means (37), by an electric connection (32) connected to a sequencer, not shown. This housing (17) is placed on a cushion (33) acting as a damper while a set of seals (34) assures the sealing at all levels. The housing is made, for example, of metallized plastic and constitutes an ideal housing for the control electronics of EFI (1).

The whole device is closed by a cap (35) made integral with back end (16) by an known means such as a screw system (40). In these figures, a single generator has been shown, but as has been stated above, the invention applies more particularly when these generators are grouped in a battery.

Figure 3:
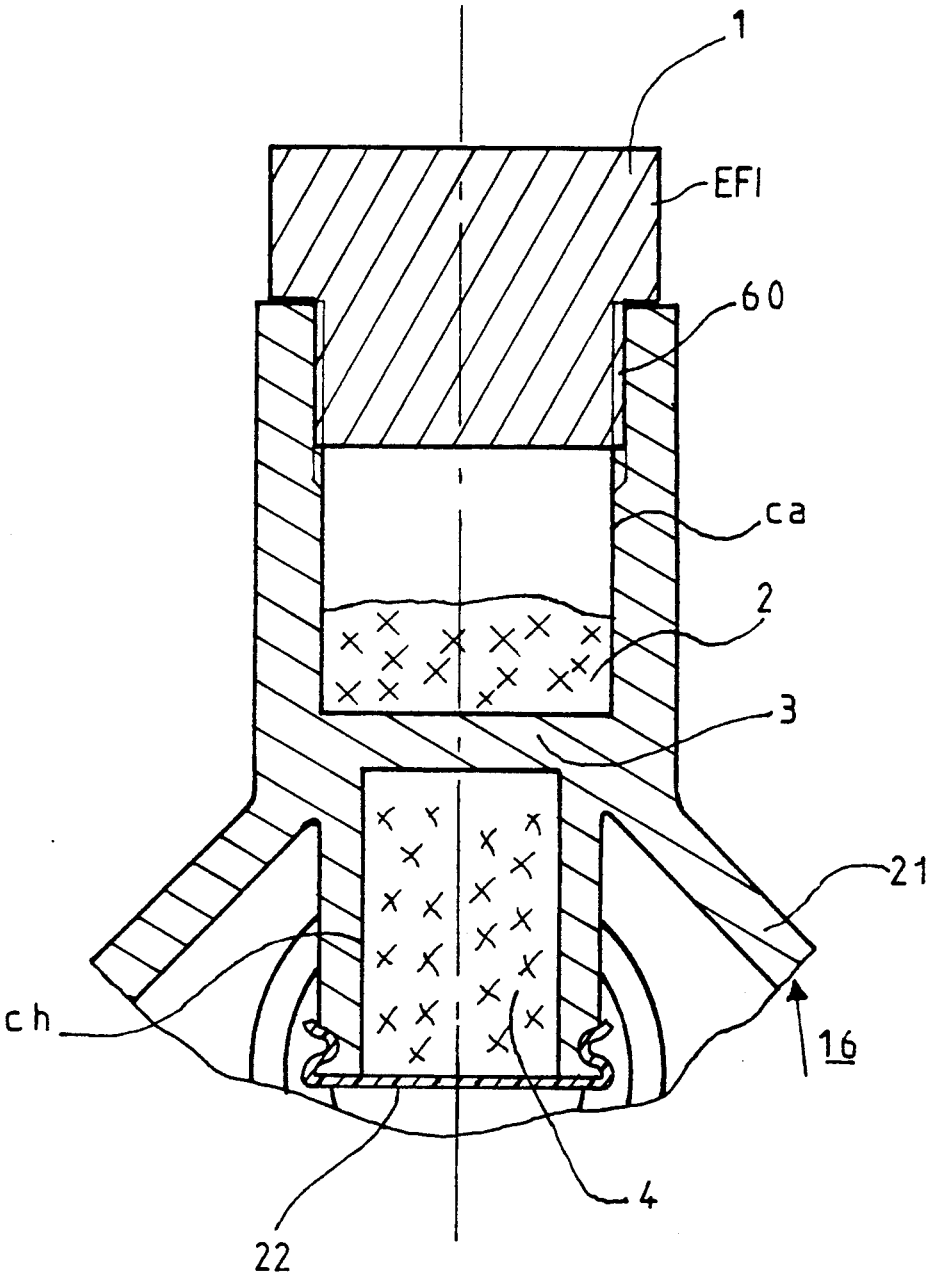
FIG. 3 is another example of use of an electropyrotechnic combination according to the invention.

FIG. 3 illustrates another embodiment of combination (EFI-IFOC) integrated in nozzle-holder back end (16). The two bores delimiting upstream cavity (Ca), downstream chamber (Ch) and airtight barrier (3) are as indicated previously, but in this embodiment, EFI (1) is made directly integral with nozzle-holder back end (16) by, for example, a threading (60). Such a structure contributes to making the unit also more compact.

Figure 4:
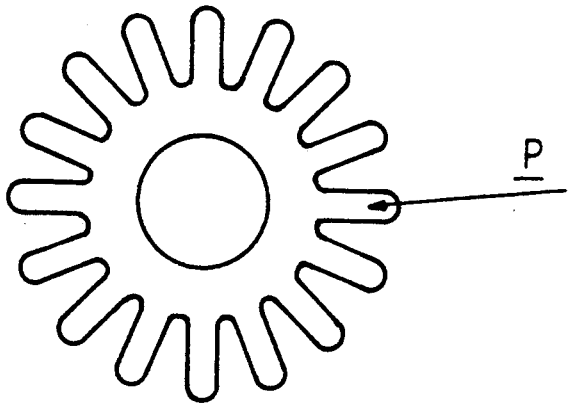
FIG. 4 is an example illustrating the profile of a powder block used for charging gas generators equipped with an electropyrotechnic combination according to the invention.
Figure 5:
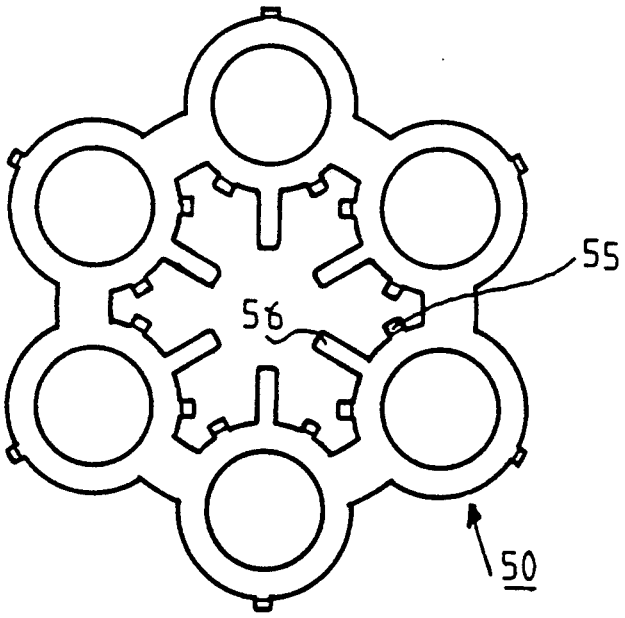
FIG. 5 is an illustration of a grid used for charging gas generators.

As FIG. 4 and FIG. 5 show, the propellant charging consists of seven powder blocks (P) whose combustion profile is star-shaped (FIG. 4). These powder blocks (double-base propellant) are held by two metal grids (50) provided with wedging claws (55) and spacing elements (56).

As has already been stated above, in such a structure as described according to the invention, a propellant ignition at a constant pressure combustion is assured without having to introduce electric means inside the charge. The ignition necessitates the use only of secondary explosives, which contribute to the reliability of the system. Utilizing a combination of an EFI and an IFOC further makes it possible to integrate these means as well as the electronic control means of an EFI (1) inside the general structure of gas generator (g) without danger of gas passage. The existence of cap (35) on the one hand and closing element (21) on the other hand provide an assurance of a second function, namely, that of propagating the shock wave at the level of airtight barrier (3) of the IFOC.

The electronic control means are compacted inside a housing located inside the general structure of the gas generator.

The invention applies each time a battery of generators is used, as is the case of the release of air-to-surface submissile rounds from a cargo aircraft.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by LETTERS PATENT of the United States is:

1. System for an electropyrotechnic device intended to trigger the operation of a powder generator placed inside a ring having a front end and a back end, said system comprising:

a downstream chamber containing an IFOC secondary receiving explosive for detonating under the effects of a shock wave to cause flames causing the triggering of the powder generator by shock wave detonation, said chamber being made in a first bore of a closing element of the back end of the ring which has a shape of a truncated cone with nozzles coming out of a side wall of the back end;

an upstream cavity containing a donor secondary explosive and made in a second bore placed head-to-tail relative to the first bore and separated from the first bore by an airtight barrier which consists of a zone of the closing element of the back end of the ring;

a EFI projected-layer initiator for producing, when initiated, a detonation in the upstream cavity, said initiator positioned coaxial with said upstream cavity; and a housing capping the back end and having a bottom in the shape of a truncated cone, complementary to the truncated cone of the back end of the ring.

2. System according to claim 1, wherein the housing has a cover which encircles the EFI placed between said cover and a vertex of the truncated cone of the housing.

3. System according to claim 1, wherein the EFI is made integral with a vertex of the back end of the ring.

4. System according to claim 1, wherein control electronics of the EFI are contained inside the housing.

5. System according to claim 1, wherein a cap covers the unit consisting of the housing, the EFI, the IFOC, and the back end of the ring.

6. System according to claim 1, wherein a charging of the ring is achieved by multiple double-base powder blocks having a star-shaped profile which, along with its composition, assures an almost constant pressure during the combustion period.

7. System according to claim 6, wherein the powder blocks are held by a pair of metal grids.

8. System according to claim 1, wherein at least two diametrically opposite nozzles come out in the side wall of the back end.

* * * * *